United States Patent [19]

Sogo et al.

[11] 4,222,772

[45] Sep. 16, 1980

[54] STRUCTURAL STEEL PLATE HIGHLY RESISTANT TO NITRATE STRESS CORROSION CRACKING

[75] Inventors: Yasuo Sogo; Hiroki Masumoto, both of Kitakyushu; Kazunari Yamato, Sagamihara; Yasuhiko Miyoshi, Tokyo; Tomomi Murata, Yokohama; Eiji Sato, Kawasaki, all of Japan

[73] Assignee: Nippon Steel Corporation, Tokyo, Japan

[21] Appl. No.: 14,631

[22] Filed: Feb. 23, 1979

[30] Foreign Application Priority Data

Feb. 24, 1978 [JP] Japan ..... 53/19725

[51] Int. Cl.[3] ..... C22C 37/10; C22C 39/14; C22C 38/06

[52] U.S. Cl. ..... 75/124; 75/126 C; 75/126 F

[58] Field of Search ..... 75/124, 126 F, 126 C

[56] References Cited

U.S. PATENT DOCUMENTS

| | | | |
|---|---|---|---|
| 2,542,220 | 2/1951 | Urban et al. | 75/124 |
| 3,291,655 | 12/1966 | Gill et al. | 75/124 |
| 3,539,338 | 11/1970 | Mimino et al. | 75/126 F |
| 3,600,161 | 8/1971 | Inouye et al. | 75/124 |
| 3,834,897 | 9/1974 | Nevalainen | 75/124 |

FOREIGN PATENT DOCUMENTS

| | | | |
|---|---|---|---|
| 47-23055 | 6/1972 | Japan | 75/125 |

OTHER PUBLICATIONS

"Low-Carbon Chromium Steel Combines Weldability and Strength," Metals & Materials, 11/75, pp. 27-29.

*Primary Examiner*—L. Dewayne Rutledge
*Assistant Examiner*—Upendra Roy
*Attorney, Agent, or Firm*—Wenderoth, Lind & Ponack

[57] ABSTRACT

Steel plates having excellent resistance to nitrate stress corrosion cracking often encountered in hot stoves, and high temperature heating furnaces, etc., and comprising:

C: 0.005–0.11%;
Si: 0.1–1.0%;
Mn: 0.1–2.0%;
P: not more than 0.025%;
S: not more than 0.025%;
Cr: 2–6%;
Nb: 0.01%–7(C+N)%;
Al: 0.01–0.20%;
(C+N): not more than 0.06%;

and optionally Mo: 0.1 to 1.5%, with the balance being essentially Fe and unavoidable impurities.

3 Claims, 11 Drawing Figures

SCC susceptibility in terms of (C+N) content and the ratio of Nb/(C+N), degree of carbide stabilization Suffix No. 1-11 indicate the steels shown in Table 4 respectively.

1. Bellows and flange in connecting pipe
2. Connecting part to DOME shell and connecting pipe
3. Manhole being closed after contraction
4. Highly stressed place near the weld line in the shell
5. Place near the jig welded point Schematic illustration of the shell wall structure of a hot stove and the site of SCC Cross sectional view of stress corrosion cracking SCC susceptibility in terms of Cr and (C+N) contents SCC susceptibility in terms of (C+N) content and the ratio of Nb/(C+N), degree of carbide stabilization Suffix No. 1-11 indicate the steels shown in Table 4 respectively.

Effects of Mo and Mo-Nb addition on the SCC of Cr-containing steels

SCC resistance of the steel B of the present invention at weldments in comparison with that of a reference steel F using the parameters of the temperature, the stress level and the chloride ion concentration.

* The compositions of steels B and F are listed in Table 2.

STRUCTURAL STEEL PLATE HIGHLY RESISTANT TO NITRATE STRESS CORROSION CRACKING

BACKGROUND OF THE INVENTION

1. Field of the Invention

The present invention relates to structural steel plates having markedly improved resistance to stress corrosion cracking caused by nitrate as often encountered by the shell plates of hot stoves, boilers and high temperature heating furnaces which generate $NO_x$.

Generally in hot stoves and high temperature heating furnaces, the combustion gases containing nitrogen oxides, such as NO, $NO_2$ and $N_2O_4$, condensate on to the inner shell surfaces forming nitrate when they are cooled below their dew points. It is well known in the field that when the shell, conventionally made of structural low-alloy steels containing 1.0% or less Cr, Ni and V, is contacted with this nitrate solution, it is very often susceptible to stress corrosion cracking.

This cracking phenomenon has been called "nitrate stress corrosion cracking (nitrate SCC)", and causes a more and more crucial problem to be solved in modern hot stoves and heating furnaces where the amount of $NO_x$ is ever increasing as the treating temperature is raised.

For clear understanding of this phenomenon, the description about a hot stove is made in FIG. 1.

When a hot stove is subjected to nitrate SCC in actual operations as shown in FIG. 1, it has been found that the cracking mostly occurs near a weld zone which includes the weld for jigs during construction, and highly stressed portions.

The cracks initiate at inner surface of a hot stove shell as illustrated in FIG. 2 and propagates toward through-thickness direction.

FIG. 3 shows the cross-sectional view of nitrate SCC.

In nitrate SCC of structural steels, various factors such as (1) the presence of nitrate and a temperature; (2) the external stress plus residual stress and (3) segregation of certain elements and carbide formation along grain boundaries have been considered to be entangled.

As described before, nitrate SCC initiates at hard spots near the weld zone and propagates along grain boundaries into matrix toward through-thickness direction as shown in FIG. 3.

In particular, the nitrate SCC depends on the localized corrosion due to the segregation of such elements as C, N and P, and carbides formed along grain boundaries, which become a preferential dissolution path for SCC.

The present inventors have found that, in addition to the above factors, a fourth one, the ability of the steel to be repassivated upon its chemical breakdown of the passivity in the presence of a very small amount of chloride ion contained in the combustion gases.

Based on the above findings, the present inventors have succeeded in developing a new structural steel plate by controlling the repassivation process in addition to the reduction of segregation along grain boundaries for preventing the cracking of the shell.

The stable passive film formation of steels is closely related to the steel composition, particularly contents of Cr and Mo.

Also it has been found that co-presence of Cr and Mo further improves high temperature strength and the toughness of the thick plate to a great extent. By these reasons, Cr and Mo are essential elements.

On the other hand, the control of the (C+N) content is a very useful means in reducing the segregation and carbides formation along with grain boundaries.

At a weld zone, however, additional remedy has to be made particularly when Cr is added to the steel since Cr depletion may occur at grain boundaries in the heat affected zone (HAZ) due to the formation of Cr carbides upon welding, which leads to a preferential dissolution path for nitrate SCC.

The formation of Cr depletion can be completely avoided by the addition of strong carbide formers such as Nb.

The addition of Nb and the control of the ratio of Nb/(C+N), the degree of carbide stabilization are indirectly effective for the enhancement of the repassivation ability at the weld zone of Cr-containing steels through the elimination of Cr depletion, which becomes a preferential dissolution path, by the formation of Nb carbide and nitride at higher temperature than Cr.

The importance of Cr depletion in preventing SCC of low alloyed structural steel plates is firstly noticed by the present inventors.

Meanwhile, since the shell of a hot stove or a heating furnace is usually a large welded structure, it is needless to say that the steel must satisfy the requirements of mechanical properties, weldability (including hardenability, resistance to mechanical cracking and joint properties), workability (gas cutting and bending) and economical requirements in addition to the above resistance to nitrate SCC both in the base plate and the weld zone.

Among all, the weldability and the gas cutting property are most important for commercial grades of steels in practical service: From the point of weldability, the content of carbon is severely restricted, while, from the point of gas cutting property, the chromium content is also severely restricted.

SUMMARY OF THE INVENTION

The present invention is based on the above knowledges and discoveries, and the steel according to the present invention comprises:

C: 0.005–0.11%;
Si: 0.1–1.0%;
Mn: 0.1–2.0%;
P: not more than 0.025%;
S: not more than 0.025%;
Cr: 2–6%;
(C+N): not more than 0.06%; and
Nb: 0.01%–7(C+N)%;
Al: 0.01 to 0.20%;

and optionally comprises 0.01 to 1.5% Mo for further improvements of strength, toughness and corrosion resistance.

The steel plate according to the present invention shows markedly improved resistance to the nitrate stress corrosion cracking and has commercial advantage that it can be used for large welded structures.

Thus, the present invention is characterized in that a certain content of chromium is maintained so as to form a stable passive film, and the amount of (C+N) is restricted and niobium is added so as to reduce the chromium carbides and to stabilize the film at grain boundaries in HAZ maintaining required weldability and gas cutting property, and that in application where $Cl^-$ ion is present, molybdenum is added for improving the stability of the passive film, namely, the corrosion resistance.

DETAILED DESCRIPTION OF THE INVENTION

Hereinbelow the present invention will be described in more detail with reference to the attached drawings.

BRIEF EXPLANATION OF THE DRAWINGS

FIG. 8(*b*) shows the set-up of U-bend loading.

According to the present invention, the steel composition is defined as above for the following reasons.

Regarding the carbon content, a lower carbon content is more preferable from the view points of the stability of passive films and reduction of carbide formation and the improvement of weldability, and the upper limit of the carbon content is set at 0.11%, while the lower limit is set at 0.005% which is necessitated from the requirements in practical steel making and required to maintain a certain level of strength. A preferable carbon range is not more than 0.056% in view of the resistance to SCC.

Meanwhile, the carbon content has a close relation with the content of nitrogen in the phenomenon of nitrate SCC. As described hereinbefore, the nitrate SCC occurs along with grain boundaries in the steel for hot stove, and for the purpose of preventing the cracking, it is effective to lower the amounts of carbides and nitrides at the grain boundaries and to reduce the segregation of elements, such as C, N and P as little as possible. As understood from FIG. 4, the nitrate SCC in the base steel definitely depends on the ability of the base steel to form the stable passive film.

Therefore, at the weld zone, chromium-containing carbides and nitrides precipitate along the grain boundaries in the bond and HAZ portions with the formation of chromium depletion, and at these portions the nitrate SCC becomes preferable. In order to solve the above-mentioned problem, the addition of niobium, which is a strong carbide and nitride former, is necessary to form niobium carbide or carbonitride instead of Cr carbides. Thus, prevention of the chromium depletion at the bond and HAZ portions can be attained under the restriction of the absolute amount of (C+N) to avoid extra hardening of weld zone due to those fine carbide precipitation.

Figure 5:
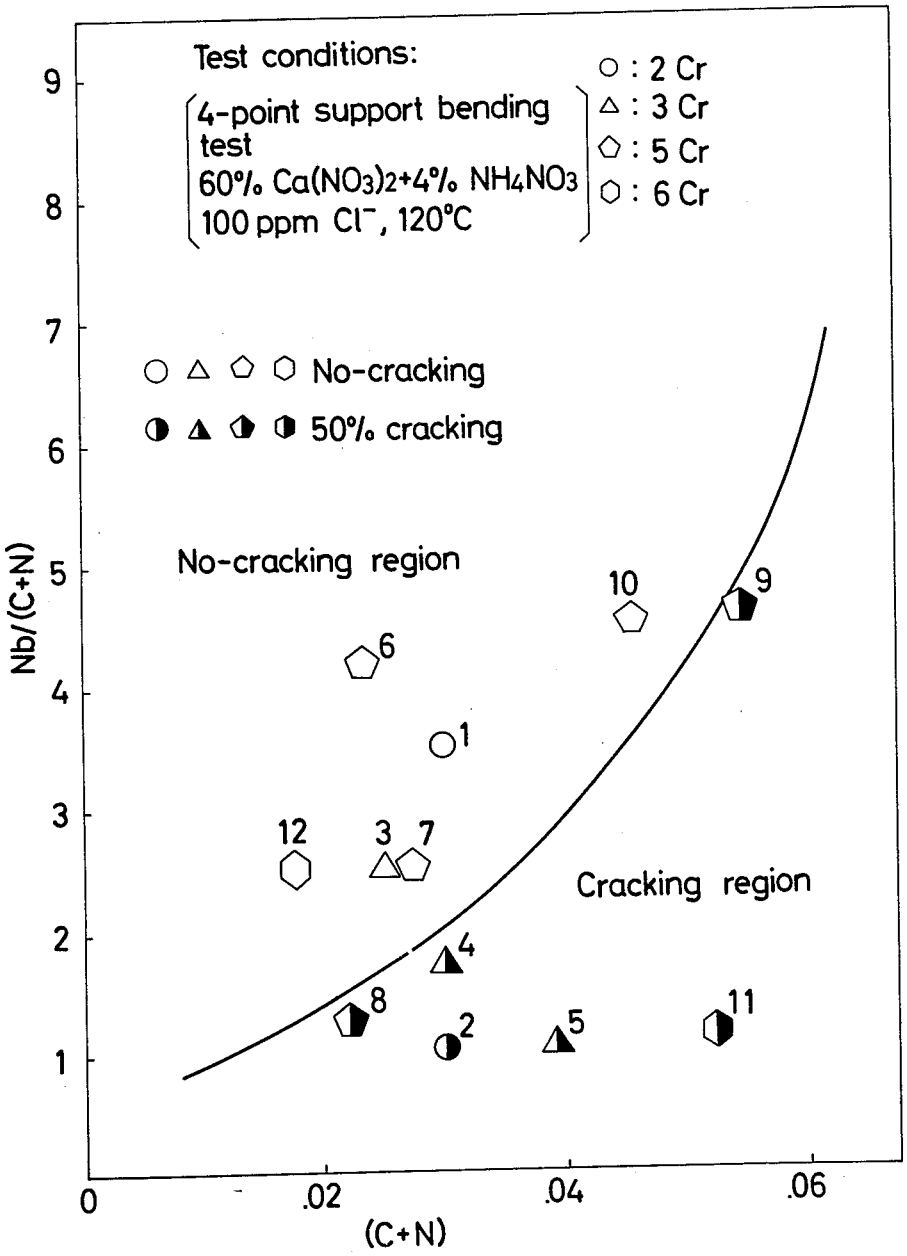
FIG. 5 shows SCC susceptibility in terms of (C+N) content and the ratio of Nb/(C+N), the degree of carbide stabilization.

For determining an appropriate range for the (C+N) contents, steels containing 2 to 6% Cr shown in Table 4 were subjected to SCC tests (four points support bending test), and the results are shown in FIG. 5 in which the cracking region is illustrated in connection with the Nb/(C+N) ratio and the (C+N) content. The (C+N) contents required for completely preventing the stress corrosion cracking in the weld zone as well as in the base steel is 0.06% or less.

Meanwhile the lower limit of the (C+N) content is 0.005% which has been determined from the requirements for strength and toughness.

The chromium content is limited to the range from 2 to 6% in the present invention.

Figure 1:
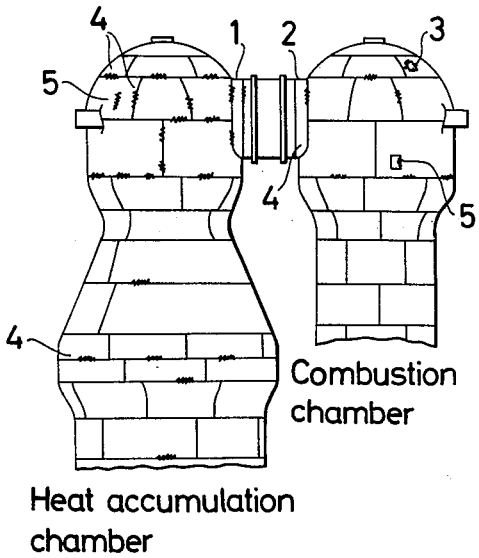
FIG. 1 shows portions of a hot stove which are subjected to the stress corrosion cracking.
Figure 2:
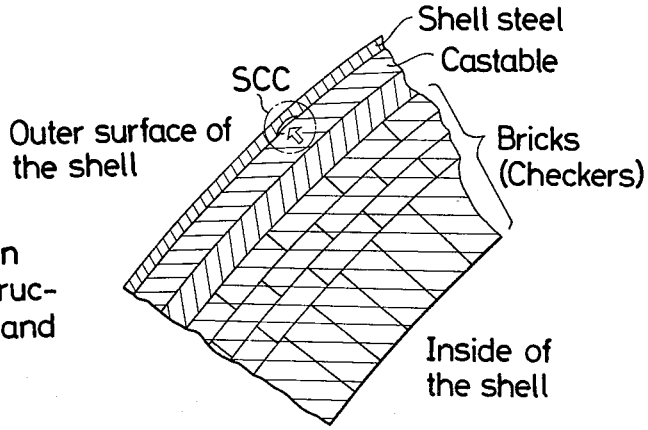
FIG. 2 shows schematic illustration of the shell wall structure and SCC found at inner shell surface of a hot stove.
Figure 3:
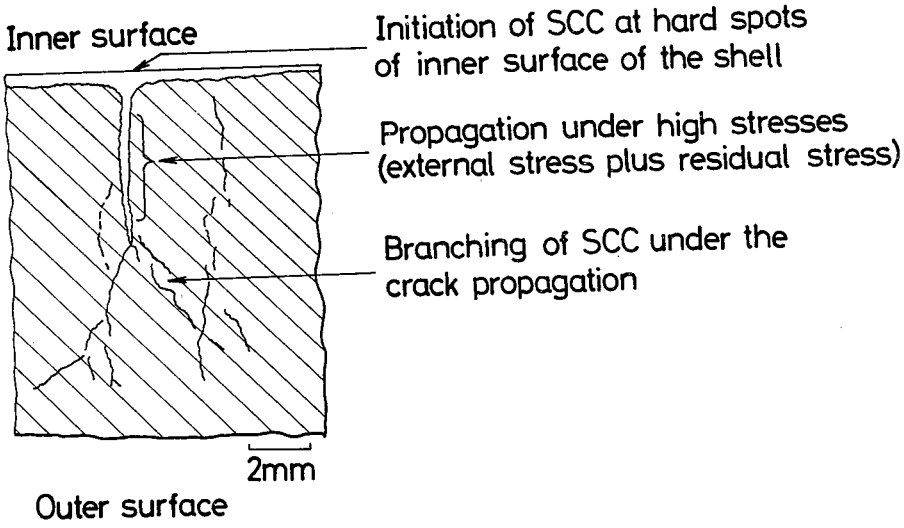
FIG. 3 is a cross sectional view of stress corrosion cracking.
Figure 4:
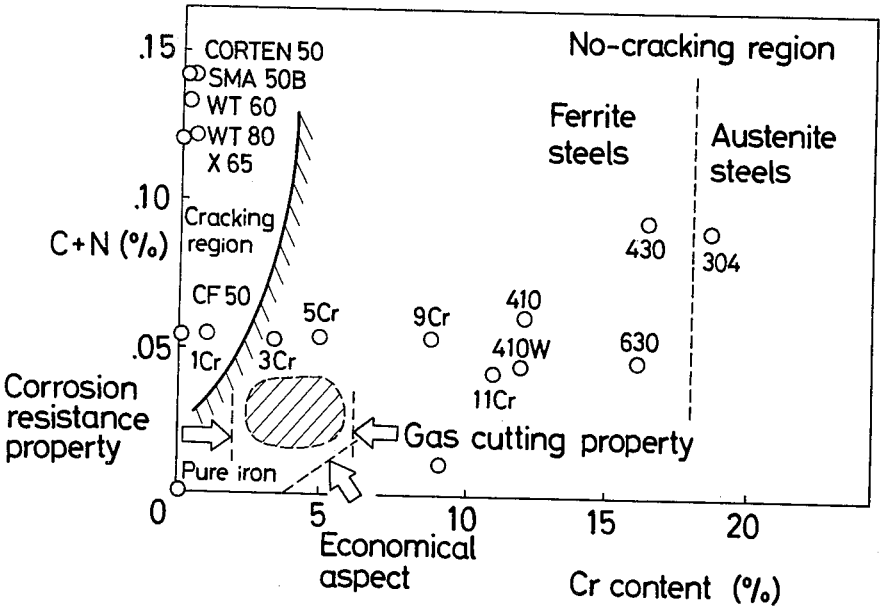
FIG. 4 shows SCC susceptibility in terms of Cr and (C+N) contents.

As clearly understood from FIG. 4, when the chromium content is 2% or more, the stress corrosion cracking will not occur assuming (C+N) content is 0.06% or less even in a nitrate environment containing a small amount of chloride as supposed to be contained in actual applications.

On the other hand, when the chromium content exceeds 6%, the gas cutting property becomes drastically poor as shown in Table 1 so that it is very difficult to gas-cut a thick steel plate, thus requiring the plasma or powder cutting.

Also so far as the chromium content is within the above range, there is no substantial problem in respect to the strength and toughness of the base steel and weld zone as well as a general economical aspect.

A preferable range of the chromium content is from 3 to 5% from the aspects of stress corrosion resistance and gas cutting property.

Niobium is an essential element in the present invention, and particularly effective to ensure the weld zone free from the stress corrosion cracking by avoiding the formation of Cr depletion upon welding, and the appropriate range of niobium is 0.01%–7×(C+N)%. As niobium is a strong carbide and nitride forming element, and is considered to be effective to keep grain boundary from Cr depletion by the formation of Nb carbide and nitride at higher temperature than Cr, thus stabilizing the passive film at bond and HAZ. The Nb content less than 0.01% will not produce any tangible effect, and when the niobium content exceeds 7×(C+N)%, excessive niobium which is not fixed as carbide or nitride forms Fe-Nb compounds causing considerable embrittlement of the steel. Also the excess precipitation of niobium carbide or carbonitride tends to give unnecessary hardness to the weldments.

Aluminum is an deoxidizer and at the same time a strong nitride forming element, and fixes N as AlN to prevent the segregation of nitrogen to the grain boundaries, thus improving the intergranular corrosion resistance. With aluminum contents less than 0.01%, sufficient deoxidation and nitrogen fixing cannot be assured, but more than 0.2% the toughness and ductility of the steel are adversely affected. Thus the aluminum content is limited to the range from 0.01% to 0.2%.

Silicon and manganese have no relation with the resistance to stress corrosion cracking, and these elements are limited to the ranges as conventionally contained in ordinary low alloyed structural steels.

Phosphorus and sulfur are usually contained in steels respectively in a range from 0.001 to 0.040% as impurities. These elements are more likely to segregate at grain boundaries and deteriorate the resistance to nitrate SCC or the notch toughness. Therefore these elements are limited to the range not more than 0.025% respectively. Particularly, the phosphorus contents is preferably limited to 0.015% or less from the standpoint of SCC.

Figure 6:
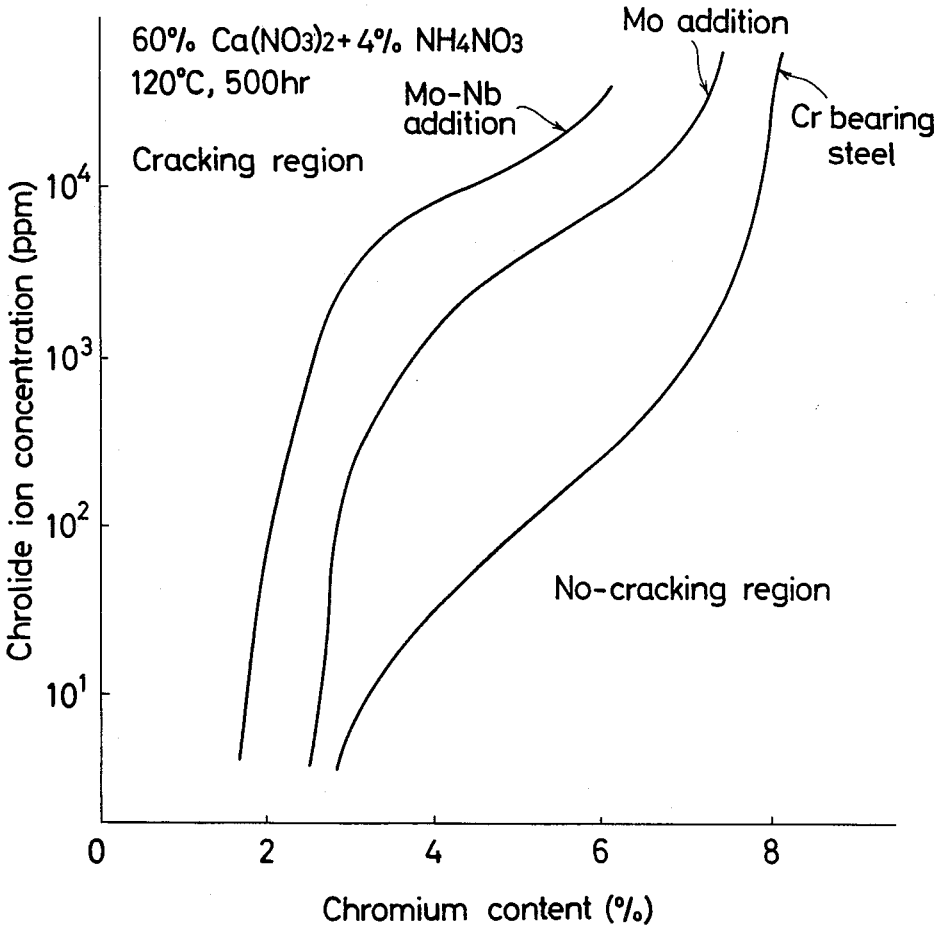
FIG. 6 shows effects of Mo or Mo-Nb addition on the nitrate SCC of Cr-containing steels.

Molybdenum is added in the range from 0.1 to 1.5% in the present invention to stabilize the passive film in environments containing chloride. In particular, as shown in FIG. 6, as the molybdenum addition expands the zone free from the nitrate stress corrosion cracking to the higher side of chloride ion concentration, it is effective to improve the resistance to nitrate SCC. However, molybdenum addition more than the upper limit rather increases the strength excessively and deteriorates the toughness and workability of the steel. A preferable range of molybdenum is from 0.3 to 0.5% from the practical purpose.

FIG. 6 shows the critical curve between the crack free zone and the cracking zone in steels containing 0.04 to 0.06% (C+N) without Nb addition in correlation with the chromium contents and the chloride ion concentration. It is clearly understood from FIG. 6 that a certain amount of chromium is necessary for a given amount of chloride ion concentration to avoid SCC particularly at weld zone.

The addition of molybdenum is also effective in improving the resistance of the steel to SCC.

Regarding nitrogen, not more than 70 ppm as usually contained in ordinary converter steels is preferable and sufficient.

Further, according to the present invention, titanium and vanadium which are carbide and nitride forming elements just as niobium may be added in a small amount for the purpose of improving the resistance to SCC, but their effect is not so efficient as niobium.

Copper and nickel may be added for the purpose of forming a stable protective film and improving resistance to corrosion in nitrates, and also tungsten may be added similarly for the purpose of stabilizing the passive film.

As understood from the above results, for obtaining a weld portion highly resistant to the nitrate environments containing a very small $Cl^-$ ion as supposed to be contained in actual service conditions, it is essential to add certain amount of chromium, to lower the (C+N) contents and to fix carbon and nitrogen with niobium addition.

Based on the above knowledges and discoveries the present inventors have developed Nb-containing structural steels with a low (C+N) content and 2 to 6% Cr which are very useful for the shell structure of hot stoves, heating furnaces, boilers and the like and free from nitrate stress corrosion cracking in such applications.

The steel of the present invention may be produced by a converter and ingot-making process or by a continuous casting process just as conventional steels.

Regarding the welding of the present steel, low-carbon austenitic steel, such as SUS 309S or SUS 308 series, may be used as the welding rods, to obtain satisfactory stength and toughness of the weldment. However, when a welding rods of the same steel composition as the base metal is used, satisfactory toughness cannot be obtained. The welding may be performed by a conventional method as used for welding ordinary thick steel plate.

DESCRIPTION OF THE PREFERRED EMBODIMENTS

The present invention will be best exemplified in the followings.

The compositions of steels A–E according to the present invention and the compositions of reference steels F and G, and their mechanical properties and their SCC test results are shown in Table 3.

The self-constraint SCC and U-bend test results in Table 3 represent the excellent performance of the present inventive steels in contrast to the poor performance of the reference steels which have been utilized for hot stoves.

Figure 7:
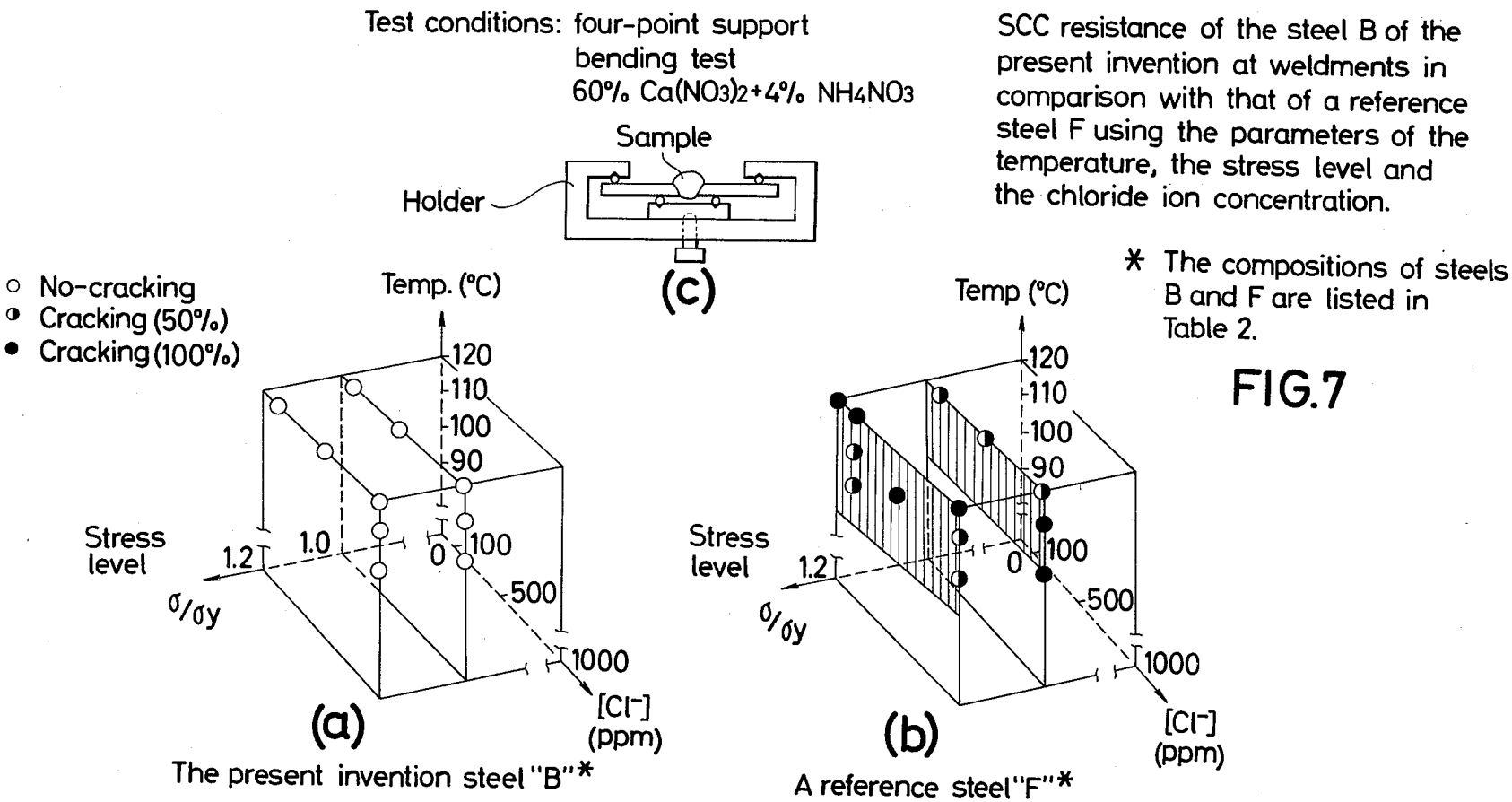
FIG. 7 shows the resistance to nitrate SCC of the present inventive steels at weldments in comparison with that of a reference steel, using the parameters of the temperature, the stress level and the chloride ion concentration.
Figure 8A:
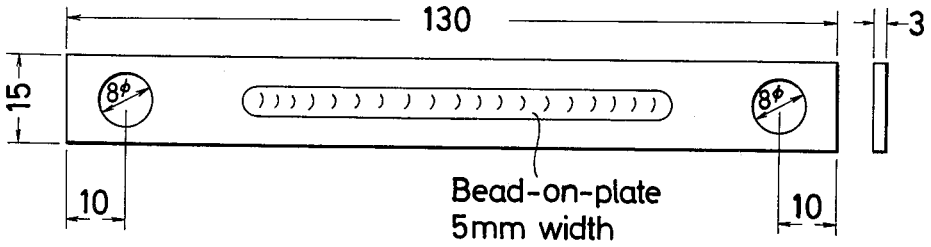
FIG. 8(*a*) shows a bead-on-plate U-bend test piece.
Figure 8B:
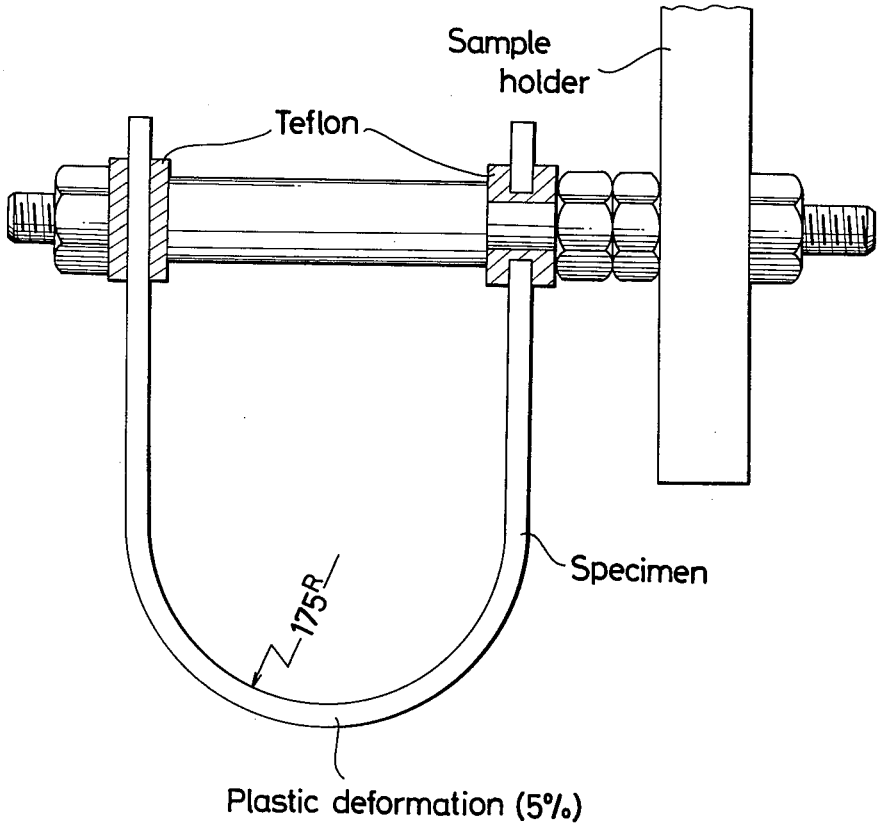
Figure 9A:
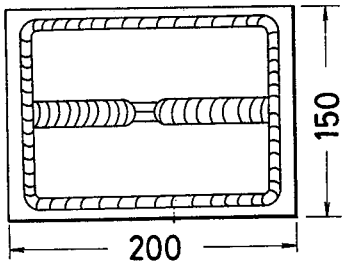
FIG. 9(*a*) shows the plane view of the test piece for self-constraint SCC test, and FIG. 9(*b*) shows the cross sectional view of the test piece.
Figure 9B:
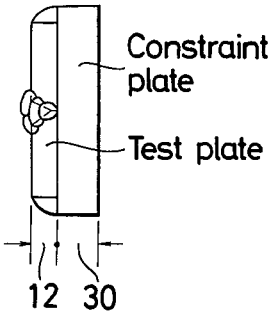

The nitrate SCC depends mainly on the operating temperature, the stress level and the chloride ion concentration. However, in FIG. 7 the resistance of the steels of the present invention to nitrate SCC at the weld zone is compared with that of the reference steels using the parameters of temperature, stress level and chloride ion concentration. While the reference steel F is suffered from SCC even under the stress level of $1.0\sigma_y$ of the steel at an average operation temperature of about 100° C., the steel B of the present invention is completely free from SCC even under the stress level of $1.2\sigma_y$ at 120° C. in the presence of 1,000 ppm of chloride ion concentration.

In actual hot stoves, the shell made of the reference steels takes 1.5 to 2.5 years before SCC occurs depending on the service conditions. It is clearly understood from this fact that the steel of the present invention has an excellent resistance to SCC.

Table 1

Relation between Gas Cutting Property and Chromium Contents

| Cr Contents (wt%) | Results of Gas Cutting* $v = 30^{cpm}$ | $v = 20^{cpm}$ | Cutting Condition |
|---|---|---|---|
| 0.5 | | | Plate thickness: 40 mm |
| 1.1 | | | Nozzle: #3 |
| 2.2 | | | $C_2H_2$ pressure: 0.3 kg/cm$^2$ G |
| 4.2 | | | $O_2$ pressure: 7 kg/cm$^2$ G |
| 4.9 | | | $v$: Cutting speed |
| 6.0 | Δ | | |
| 7.1 | X | X | |
| 9.2 | X | X | |

* as good as mild steel
Δ not good enough for welding unless additional smoothing is made
X difficult All of the test pieces were of the same steel composition except for chromium content, and were immersed in an aqueous solution of 60% $Ca(NO_3)_2$+4% $NH_4NO_3$, which is a standard solution for estimating the susceptibility to the nitrate cracking, at 120° C. for 500 hours. In some cases $Cl^-$ was added to the solution.

Table 2

| | Steels | C | Si | Mn | P | S | Cr | Mo | Nb | N | Nb/(C + N) |
|---|---|---|---|---|---|---|---|---|---|---|---|
| Steels of Present Invention | A | 0.017 | 0.32 | 0.77 | 0.018 | 0.005 | 2.1 | — | 0.05 | 0.006 | 2.17 |
| | B | 0.020 | " | 0.71 | " | 0.006 | 3.1 | — | 0.06 | 0.005 | 2.40 |
| | C | 0.015 | 0.28 | 0.80 | " | " | 3.3 | — | 0.04 | 0.006 | 1.90 |
| | D | 0.021 | 0.24 | 0.70 | 0.013 | " | " | 0.5 | 0.06 | 0.007 | 2.14 |
| | E | 0.030 | 0.21 | 0.65 | 0.016 | " | 6.0 | 0.5 | 0.08 | 0.005 | 2.28 |
| Reference | F | 0.12 | 0.45 | 1.28 | 0.019 | 0.008 | 0.5 | — | — | 0.004 | |

Table 2-continued

| | Steels | C | Si | Mn | P | S | Cr | Mo | Nb | N | Nb/(C + N) |
|---|---|---|---|---|---|---|---|---|---|---|---|
| Steels | G | 0.020 | " | 1.42 | " | 0.007 | 1.0 | 0.30 | — | 0.005 | |

Table 3

| | Steels | Plate Thickness (mm) | Heat Treatment | Tensile Properties (JIS Z2201, No. 4 test piece) Yield Point (kg/mm²) | Tensile Strength (kg/mm²) | Elongation (%) | vE0* (kg . m) | Results of SCC Test U-Bend Test | Self-Constraint Test |
|---|---|---|---|---|---|---|---|---|---|
| Steels of Present Invention | A | 22 | Quenching + Tempering | 38.1 | 52.2 | 34 | 28.6 | No cracking | No cracking |
| | B | 24 | Quenching + Tempering | 39.0 | 55.0 | 36 | 30.8 | No cracking | No cracking |
| | | " | Quenching + Tempering | 41.0 | 55.2 | 34 | 32.2 | No cracking | No cracking |
| | C | 40 | Quenching + Tempering | 40.6 | 55.0 | 34 | 33.1 | No cracking | No cracking |
| | D | 25 | Quenching + Tempering | 37.1 | 57.1 | 30 | 29.2 | No cracking | No cracking |
| | E | " | Normalizing +Tempering | " | 54.9 | " | 27.6 | No cracking | No cracking |
| Reference Steels | F | " | Normalizing | 36.2 | 58.2 | 33 | 26.2 | Cracking | Cracking |
| | G | " | Quenching + Tempering | 39.2 | 56.5 | 34 | 30.1 | " | " |

*2 mm V Charpy absorbed energy at 0° C.

TABLE 4

| Steels | Elements Cr | C | N | Nb | Mo | Nb/(C + N) | Results of SCC Test on the Weldments (4-point Support Bending Test |
|---|---|---|---|---|---|---|---|
| 1 | 2.10 | 0.0251 | 0.0049 | 0.105 | 0.25 | 3.5 | No cracking |
| 2 | 2.00 | 0.0249 | 0.0061 | 0.036 | — | 1.20 | Cracking |
| 3 | 3.25 | 0.0149 | 0.0041 | 0.050 | 0.25 | 2.50 | No cracking |
| 4 | 3.01 | 0.0248 | 0.0052 | 0.054 | 0.50 | 1.81 | Cracking |
| 5 | 3.05 | 0.0340 | 0.0050 | 0.043 | — | 1.10 | Cracking |
| 6 | 4.90 | 0.0177 | 0.0013 | 0.079 | 0.50 | 4.15 | No cracking |
| 7 | 4.70 | 0.0160 | 0.0040 | 0.050 | — | 2.50 | No cracking |
| 8 | 4.95 | 0.0171 | 0.0049 | 0.029 | 0.25 | 1.30 | Cracking |
| 9 | 5.00 | 0.0487 | 0.0053 | 0.248 | 0.50 | 4.60 | Cracking |
| 10 | 5.05 | | | | 0.25 | 4.51 | No cracking |
| 11 | 6.20 | 0.0047 | 0.0048 | 0.057 | 0.50 | 1.10 | Cracking |
| 12 | 6.15 | 0.0134 | 0.0041 | 0.437 | 0.50 | 2.51 | No cracking |

In all of the above test pieces, Si is about 0.25%, P is about 0.015%, Al is about 0.25%, Mn is about 0.7% and S is about 0.006%.

What is claimed is:

1. Structural steel plates having excellent resistance to nitrate stress corrosion cracking for use as shell plates for hot stoves, boilers and in high temperature heating furnaces, consisting essentially of:

C: 0.005–0.056%;
Si: 0.1–1.0%;
Mn: 0.1–2.0%;
P: not more than 0.025%;
S: not more than 0.025%;
Cr: 2–6%;
Nb: 0.01%–7 (C+N)%;
Al: 0.01–0.20%;
(C+N): not more than 0.06% and the balance being essentially Fe and unavoidable impurities.

2. Steel plates according to claim 1 which further contain 0.1 to 1.5% Mo.

3. Structural steel plates according to claim 1 wherein the content of the (C+N) and the ratio of Nb to (C+N) is such that the steel plates fall within the non-cracking region of the graph shown in FIG. 5 of the drawings.

* * * * *